US009004934B2

(12) United States Patent
Xu

(10) Patent No.: US 9,004,934 B2
(45) Date of Patent: Apr. 14, 2015

(54) CARD EDGE CONNECTOR

(71) Applicant: Hon Hai Precision Industry Co., Ltd., New Taipei (TW)

(72) Inventor: Guang-Lei Xu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/027,254

(22) Filed: Sep. 16, 2013

(65) Prior Publication Data

US 2014/0080345 A1 Mar. 20, 2014

(30) Foreign Application Priority Data

Sep. 14, 2012 (CN) ..... 2012 2 0468275 U

(51) Int. Cl.

| | |
|---|---|
| ***H01R 13/62*** | (2006.01) |
| ***H01R 12/72*** | (2011.01) |
| ***H01R 12/70*** | (2011.01) |
| *H01R 12/83* | (2011.01) |
| *H01R 13/64* | (2006.01) |

(52) U.S. Cl.

CPC ..... *H01R 12/72* (2013.01); *H01R 12/7029* (2013.01); *H01R 12/707* (2013.01); *H01R 12/721* (2013.01); *H01R 12/83* (2013.01); *H01R 13/64* (2013.01)

(58) Field of Classification Search

USPC ..... 439/325–329

See application file for complete search history.

(56) References Cited

U.S. PATENT DOCUMENTS

| | | | | |
|---|---|---|---|---|
| 6,893,281 | B2 * | 5/2005 | Taguchi | 439/326 |
| 7,175,461 | B1 * | 2/2007 | Ju | 439/326 |
| 7,938,664 | B2 * | 5/2011 | Hsieh et al. | 439/326 |

FOREIGN PATENT DOCUMENTS

| | | |
|---|---|---|
| CN | 202695761 U | 1/2013 |
| TW | I264167 | 10/2006 |

* cited by examiner

*Primary Examiner* — Khiem Nguyen

(74) *Attorney, Agent, or Firm* — Wei Te Chung; Ming Chieh Chang

(57) ABSTRACT

A card edge connector defines an insulative housing, the housing includes a lengthwise base portion with opposite end walls along a lengthwise direction thereof, and a card-receiving slot runs forwards for an electrical card; a plurality of terminals are loaded in the housing and the terminals defines contacting portions exposing to the card-receiving slot and welding portions extending out of the housing; a pair of latch members are fixed to the end walls, each latch member comprises a locking portion, the locking portion bends inwards and downwards slantwise, the locking portion also defines an upper guiding surface and a lower resisting surface opposite to the upper guiding surface, wherein the guiding surfaces are disposed slantwise to the electrical card while the resisting surface is parallel to the electrical card.

20 Claims, 5 Drawing Sheets

CARD EDGE CONNECTOR

BACKGROUND OF THE INVENTION

1. Field of the Invention

The present invention relates to a card edge connector, and more particularly to a card edge connector with module-locked latches.

2. Description of the Related Art

TW Pat. Issued No. I264167 issued to Hon Hai Corporation on Oct. 11, 2006, discloses a card edge connector which is electrically connected to a PCB. The card edge connector includes a lengthwise insulative housing, a pair of plastic arms extending from opposite lengthwise ends of the housing, a plurality of conductive terminals fixed to the housing, and a pair of lock mechanisms assembled to the plastic arms. The lock mechanisms include a pair of latch members for locking a module such as an electrical card inserted into the housing and a pair of welding members soldered to the PCB. Each latch member defines a locking portion with a lean resisting surface which is used to press against the electrical card. The electrical card will be damaged during insertion into the card edge connector because of the lean resisting surface.

Therefore, an improved card edge connector is desired to overcome the disadvantages of the related arts.

BRIEF SUMMARY OF THE INVENTION

An object of the present invention is to provide a card edge connector which can reduce damage of electrical card intended to be inserted into the connector.

In order to achieve above-mentioned object, a card edge connector comprises an insulative housing, the housing includes a lengthwise base portion with opposite end walls along a lengthwise direction thereof, and a card-receiving slot runs forwards for an electrical card; a plurality of terminals are loaded in the housing and the terminals comprise contacting portions exposing to the card-receiving slot and welding portions extending out of the housing; a pair of latch members are fixed to the end walls, each latch member comprises a locking portion, the locking portions bends inwards and downwards slantwise, the locking portion also defines an upper guiding surface and a lower resisting surface opposite to the upper guiding surface, wherein the guiding surfaces are disposed slantwise to the electrical card while the resisting surface is parallel to the electrical card.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
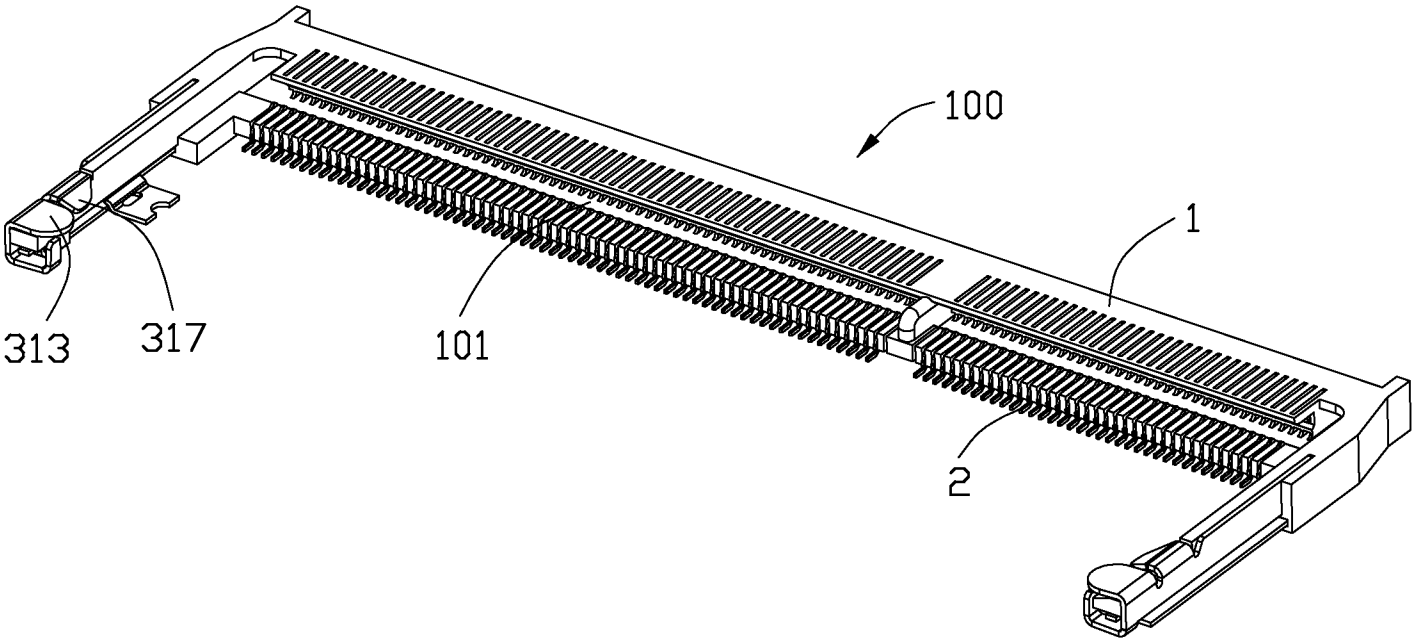
FIG. 1 is a perspective view of a card edge connector in accordance with the present invention.

Reference will now be made to the drawing figures to describe a preferred embodiment of the present invention in detail. FIG. 1 illustrates a card edge connector 100, the card edge connector 100 includes an insulative housing 1, a plurality of terminals 2 loaded in the insulative housing 1, a pair of latch members 31 and a pair of welding members 32 assembled to the insulative housing 1.

Figure 2:
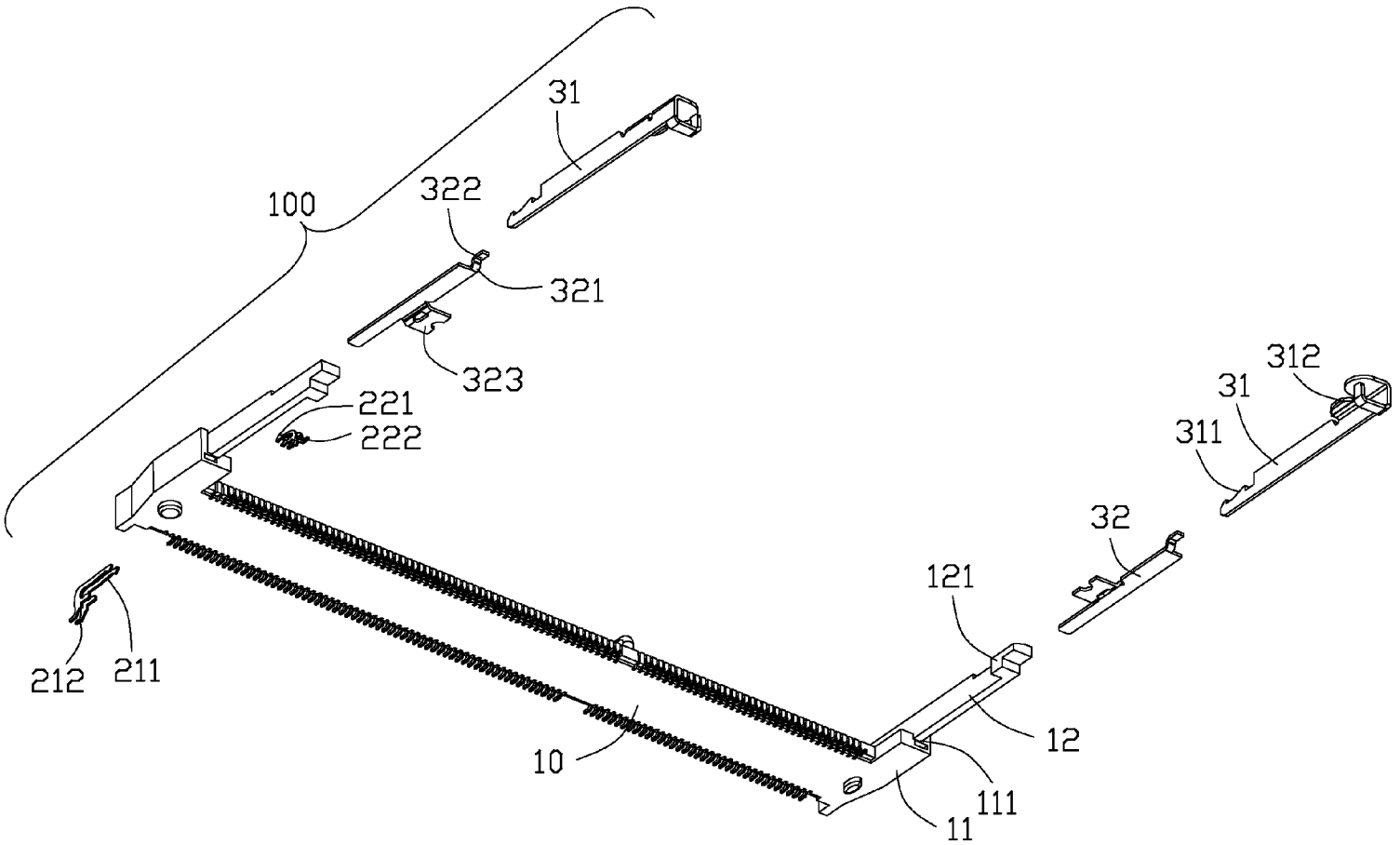
FIG. 2 is a partially exploded perspective view of the card edge connector shown in FIG. 1.
Figure 3:
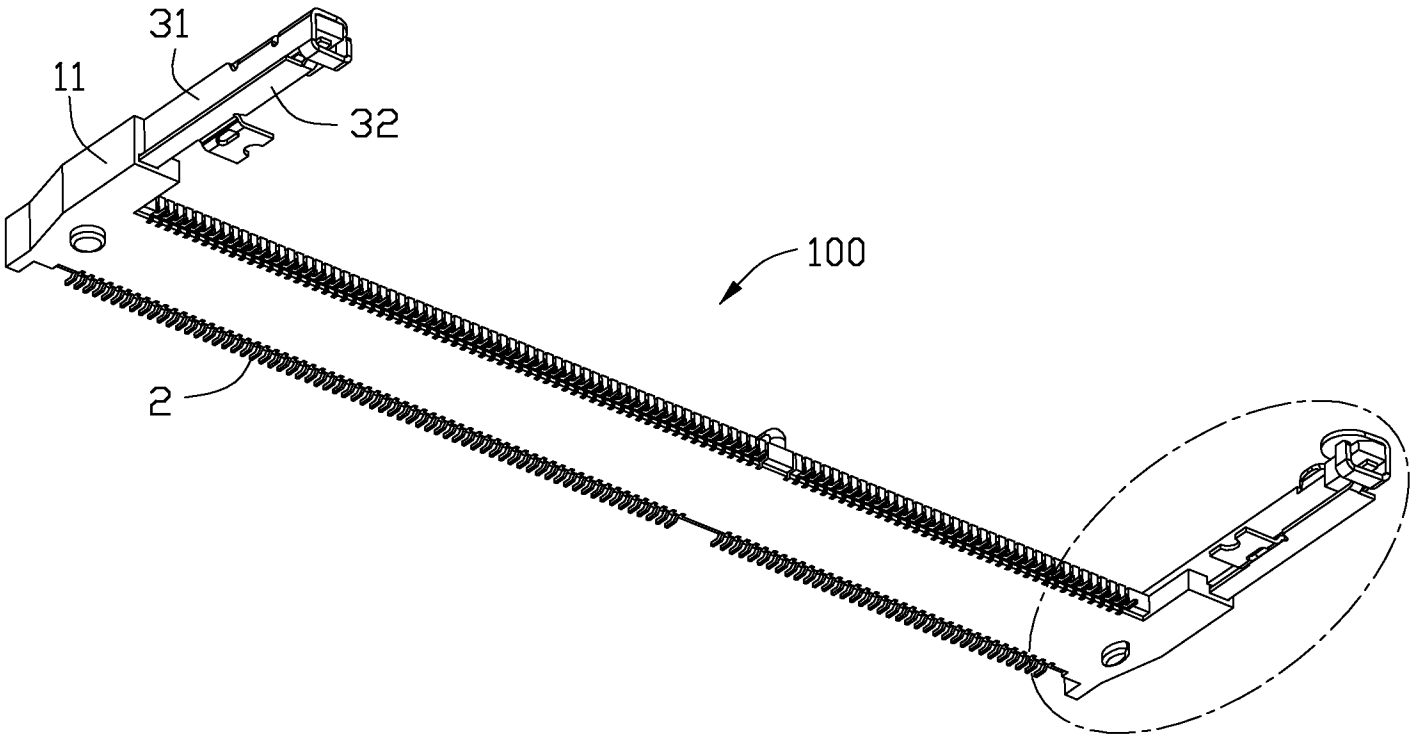
FIG. 3 is another perspective view of the card edge shown in FIG. 1
Figure 5:
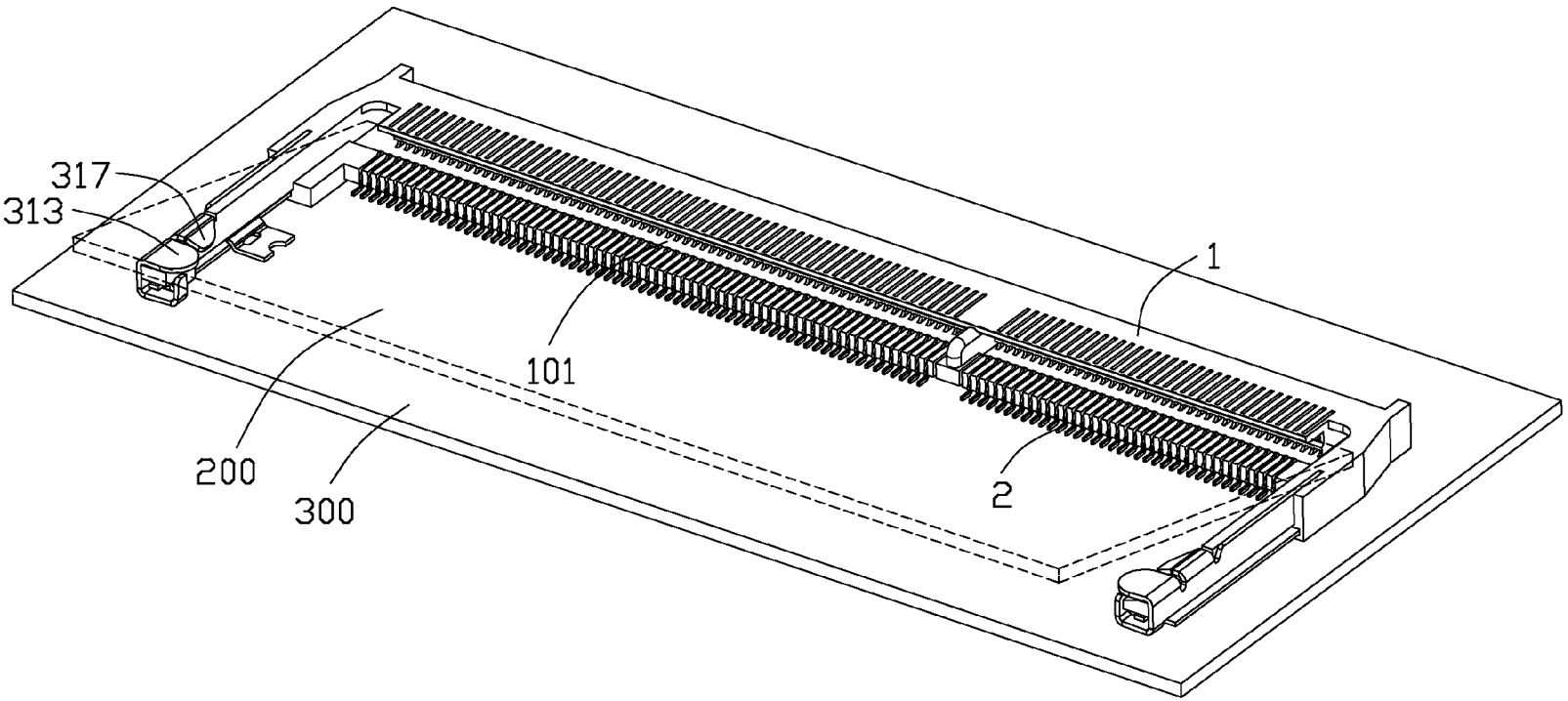
FIG. 5 is a perspective view of a card edge connector soldered onto a PCB with an electrical card inserted into the card edge connector.

Referring to FIGS. 1 and 2, the insulative housing 1 includes a base portion 10 with two opposite end walls 11 along a lengthwise direction of the base portion 10. The base portion 10 further defines a card-receiving slot 101 to receive an electrical card 200 (shown in FIG. 5). A pair of plastic arms 12 extend forwards from the end walls 11, which is disposed perpendicular to the base portion 10, and two mounting slots 111 are disposed running through front portions of the end walls 11 and below the plastic arms 12. A projecting-inward boss 121 is disposed at the inner surface of each plastic arm 12 so as to be locked into corresponding notch of the electrical card 200.

The terminals 2 are in two-row arrangement at opposite sides of the card-receiving slot 101, the upper row terminal 2 defines a first contacting portion 211 exposing downwards to the card-receiving slot 101, and a first welding portion 212 extending out of a rear surface of the base portion 10. The lower row terminal 2 includes a second contacting portion 221 exposing upwards to the card-receiving cavity 101 and a second welding portion 222 extending out of a front surface of the base portion 10. The first and second contacting portions 211, 221 are arranged along a front-back direction and are offset in a left-right direction, and the first and second welding portions 221, 222 are at a same plane.

Figure 4:
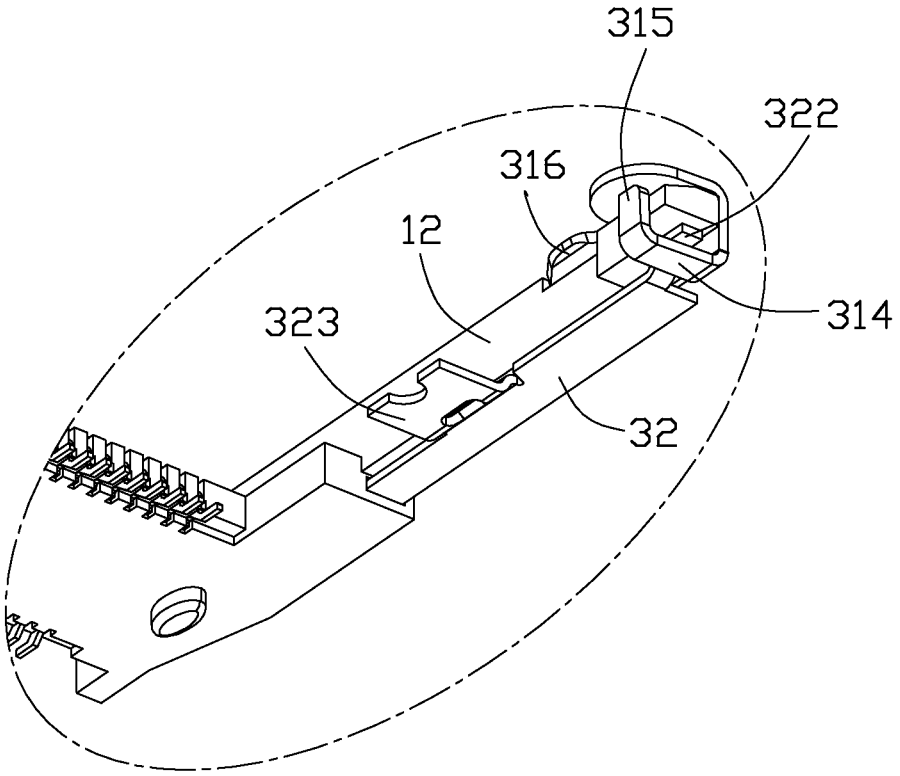
FIG. 4 is an enlarged view of a portion of the card edge connector in circle shown in FIG. 3.

The latch members 31 are attached to the outer surfaces of the plastic arms 12 and fixed to the end walls 11 by barbs 311 at the rear distal ends thereof. The front portion of each latch member 31 defines a mis-mating proof portion 313 (referring to FIG. 1) bending inwardly and horizontally, which is located above the projecting-inward boss 121 and used for engagement with the notch of the card. Referring to FIG. 4, a first resisting portion 314 located below the projecting-inward boss 121 and extends inwards from the lower edge of the front portion of the latch member 31 and a second resisting portion 315 located in an inner side of the projecting-inward boss 121, extends upwards continuously from the first resisting portion 314. A locking portion 312 extends inwards from the upper edge of each latch member 31, and the mis-mating proof portion 313 is located in front of the locking portion 312. The outer surface of the locking portion 312 leans downwards, so as to form the guiding surface 317 (shown in FIG. 1) for the electrical card 200. The inner surface of the locking portion 312 resists onto the electrical card 200 to form a resisting surface 316. The resisting surfaces 316 are parallel to electrical card 200, which is formed by partially cutting away an inner portion of the locking portion 312.

Since the resisting surfaces 316 are flat and parallel to the electrical card, the locking portion 312 and the electrical card 200 touch with each other by a face-to-face contact after rotating the electrical card 200 to a right position. Compared to the card edge connector with a conventional slantwise resisting surface of a conventional card edge connector, the damaged to the electrical card will be decreased.

Referring to FIG. 2 and FIG. 4, the welding members 32 are plate and disposed horizontally under the plastic arms 12. The opposite lateral sides of the welding members 32 are flat without any barbs and are thinner than height of the mounting slots 111 so that the welding members 32 move slightly in an up to down direction in the mounting slots 111 after the rear ends of the welding members 32 are inserted into the mounting slots 111. A bending portion 321 extends upwards from a front portion of each welding members 32 and an extending portion 322 continuously extends forwards from the bending portion 321. As best shown in FIG. 4, the first resisting portions 314 are located in front of the bending portion 321 and limit the bending portions 321 in a front-rear direction so as to prevent the welding members 32 from falling out of the end walls 11. The extending portions 322 are located above the first resisting portions 314 and below the projecting-inwards bosses 121.

The second resisting portions 315 are disposed at inner sides of the extending portions 322 and resist onto the inner surfaces of plastic arms 12 when the plastic arms 12 move outwards. The welding members 32 further define welding portions 323 extending inwards from inner edges thereof from the plastic arms 12.

In a conventionally card edge connector, the lengthwise base portion will be distorted when welded onto the PCB especially the number of terminals is large, and co-plane of the terminals and the welding members is hard to keep. In this design, this problem will be solved since the welding members 32 move in an up to down direction in the mounting slots 111 slightly (the welding members 32 are thinner than the height of mounting slots 111), in other words, the welding members 32 can be adjusted to be flattened to the PCB 300 (shown in FIG. 5), so as to benefit to the co-plane for the card edge connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, comprising:

an insulative housing including a lengthwise base portion with opposite end walls along a lengthwise direction thereof, and a card-receiving slot running forwards for an electrical card;

a plurality of terminals loaded in the housing and comprising contacting portions exposed to the card-receiving slot and welding portions out of the housing;

a pair of latch members fixed to the end walls, each latch member comprising a locking portion, bending inwards and downwards slantwise , the locking portion defining an upper guiding surface and a lower resisting surface opposite to the upper guiding surface, wherein the guiding surfaces are disposed slantwise to the electrical card while the resisting surface is parallel to the electrical card.

2. The card edge connector as described in claim 1, wherein the resisting surface is formed by cutting away an inner portion of the locking portion partially.

3. The card edge connector as described in claim 1, wherein the housing further includes a pair of plastic arms extending from the end walls with a projecting-inward boss at each front portion thereof, the latch members are attached to outer surfaces of the plastic arms and the locking portions extend to inner sides of the plastic arms and located at rear of the inward bosses.

4. The card edge connector as described in claim 1, comprising a pair of welding members, the welding members being plane and located below the plastic arms.

5. The card edge connector as described in claim 1, wherein each latch member comprises a first resisting portion extends inwards from a lower edge of a front portion of the latch member and a second resisting portion extends upwards from the first resisting portion, the welding member comprises a bending portion extends upwards from a front edge of the welding member and an extending portion extends forwards from the extending portion, the first resisting portions resist onto bending portions, the second resisting portions resist onto the inner surface of the plastic arm while the plastic arms move outwards.

6. The card edge connector as described in claim 5, wherein each welding member defines two lateral edges and the lateral edges are flat without any barbs.

7. The card edge connector as described in claim 1, wherein each latch member comprises a mis-mating proof portion extending from an upper edge of the latch member and located oppositely to the first resisting portion, and a projecting-inward boss disposed at the inner surface of the plastic arms between the mis-mating proof portion and the first resisting portion.

8. The card edge connector as described in claim 7, wherein the terminals include first contacting portions exposing downwards to the card-receiving slot and second contacting portions exposing upwards to the card-receiving slot, the first contacting portions and the second contacting portions are arranged in a front-back direction and offset in a left-right direction, the terminals define first welding portions extending out of the front end of the base portion and second welding portions extending out of a rear end of the base portion.

9. A card edge connector assembly comprising:

an insulative housing defining a central slot extending along a longitudinal direction and forwardly communicating with an exterior in a front-to-back direction perpendicular to said longitudinal direction;

upper and lower contacts disposed in the housing and located by two sides of the central slot in a vertical direction perpendicular to both said longitudinal direction and said front-to-back direction;

a pair of insulative arms unitarily formed and extending from two opposite longitudinal ends forwardly in the front-to-back direction, each of said arms defining an inward projecting boss for latching within a notch of an electronic card inserted into the central slot so as to prevent the electronic card from moving along the front-to-back direction; and a pair of metallic arms respectively associated with the corresponding insulative arms in a co-movement manner, each of said metallic arms including a locking portion equipped with an upward slanting face for allowing downward rotation of the electronic card about the central slot from an initial slanted position and a downward horizontal face for efficiently pressing an upper face of the electronic card when said electronic card is moved from the initial slanted position to a final horizontal position so as to prevent the electronic card from upward moving.

10. The card edge connector assembly as claimed in claim 9, wherein said downward horizontal face is formed by trimming a free tip of the locking portion so as to have said downward horizontal face is formed at an underside of said free tip.

11. The card edge connector assembly as claimed in claim 9, wherein a root of each of said metallic arms is secured to the housing.

12. The card edge connector as claimed in claim 9, wherein each of said metallic arm is located on an outer side of the corresponding insulative arm.

13. The card edge connector assembly as claimed in claim 9, further including a pair of welding members for mounting to a corresponding printed circuit board, are attached under the insulative arms, respectively, wherein an inner end of said welding member is loosely held in a slot of the housing while an outer end of the welding member is loosely held between the corresponding insulative arm and the corresponding metallic arm so as to allow said welding member to be in a floating manner relative to the housing.

14. The card edge connector assembly as claimed in claim 9, wherein each of said metallic arms defines a mis-mating proof portion aligned with the corresponding inward projecting boss in a vertical direction perpendicular to both said longitudinal direction and said front-to-back direction.

15. The card edge connector assembly as assembly claimed in claim 14, wherein each of said metallic arms forms a frame structure in a vertical cross-section around said mis-mating proof portion.

16. A card edge connector assembly comprising:

an insulative housing defining a central slot extending along a longitudinal direction and forwardly communicating with an exterior in a front-to-back direction perpendicular to said longitudinal direction;

upper and lower contacts disposed in the housing and located by two sides of the central slot in a vertical direction perpendicular to both said longitudinal direction and said front-to-back direction;

a pair of insulative arms unitarily formed and extending from two opposite longitudinal ends forwardly in the front-to-back direction, each of said arms defining an inward projecting boss for latching within a notch of an electronic card inserted into the central slot so as to prevent the electronic card from moving along the front-to-back direction;

a pair of metallic arms respectively associated with the corresponding insulative arms in a co-movement manner, each of said metallic arms including a resisting portion around the inward projecting boss; and a pair of welding members for mounting to a printed circuit board, located under the corresponding insulative arms, respectively, each of said welding members defining an inner rear end loosely held within a slot in the housing and an outer front end loosely held between the corresponding insulative arm and the resisting portion of the corresponding metallic arm so as to have the welding member be in a floating manner with regard to the housing.

17. The card edge connector assembly as claimed in claim 16, wherein each of said metallic arms forms a frame structure in a vertical cross-section around said mis-mating proof portion.

18. The card edge connector assembly as claimed in claim 16, wherein each of said metallic arms further includes a locking portion for downwardly pressing an upper face of an electronic card which is inserted into the housing initially in an angle position and successively in a horizontal position.

19. The card edge connector assembly as claimed in claim 16, wherein each of said metallic arms is located on an inner side of the corresponding insulative arm.

20. The card edge connector assembly as claimed in claim 16, wherein the outer front end of the welding member is upwardly offset from remainders.

* * * * *